US005324216A

United States Patent [19]

Toyohara et al.

[11] Patent Number: 5,324,216

[45] Date of Patent: Jun. 28, 1994

[54] JET PUMP SYSTEM FOR A WATER JET PROPELLED BOAT

[75] Inventors: Makoto Toyohara; Hiroshi Tasaki, both of Hamamatsu, Japan

[73] Assignee: Sanshin Kogyo Kabushiki Kaisha, Hamamatsu, Japan

[21] Appl. No.: 886,937

[22] Filed: May 22, 1992

[30] Foreign Application Priority Data

May 24, 1991 [JP] Japan ..... 3-149486

[51] Int. Cl.[5] ..... B63H 11/103

[52] U.S. Cl. ..... 440/47; 440/46

[58] Field of Search ..... 114/275, 276, 277; 440/38, 46, 47; 60/221, 222

[56] References Cited

U.S. PATENT DOCUMENTS

| | | | |
|---|---|---|---|
| 3,456,611 | 7/1969 | Johnson | 114/275 |
| 3,809,492 | 5/1974 | Takaeda et al. | 440/46 |
| 3,910,216 | 10/1975 | Shultz | 114/275 |
| 3,942,463 | 3/1976 | Johnson et al. | 440/47 |
| 4,373,919 | 2/1984 | Strangeland | 440/47 |
| 4,449,944 | 5/1984 | Baker et al. | 440/47 |
| 4,531,920 | 7/1985 | Stricker | 440/47 |
| 4,775,341 | 10/1988 | Tyler et al. | 440/38 |

FOREIGN PATENT DOCUMENTS

| | | | |
|---|---|---|---|
| 263893 | 11/1986 | Japan | 114/270 |
| 1-145598 | 10/1989 | Japan . | |
| 3213496 | 9/1991 | Japan | 440/47 |

*Primary Examiner*—Michael S. Huppert
*Assistant Examiner*—Thomas J. Brahan
*Attorney, Agent, or Firm*—Bacon & Thomas

[57] ABSTRACT

A jet pump system for a water jet propelled boat is disclosed that provides for the adjustment of the area of the water intake opening or the water entry angle as a function of the speed of the boat. During low speed operation, the water inlet opening is adjusted to a maximum area, or the water entry angle is adjusted to a maximum angle to enable sufficient water to enter the water duct and permit efficient impeller operation. As the boat speed increases beyond a predetermined speed, the water inlet area is reduced, or the water inlet angle is reduced to prevent excess water from entering the water duct, thereby reducing the drag on the boat.

4 Claims, 6 Drawing Sheets

FIG. 5
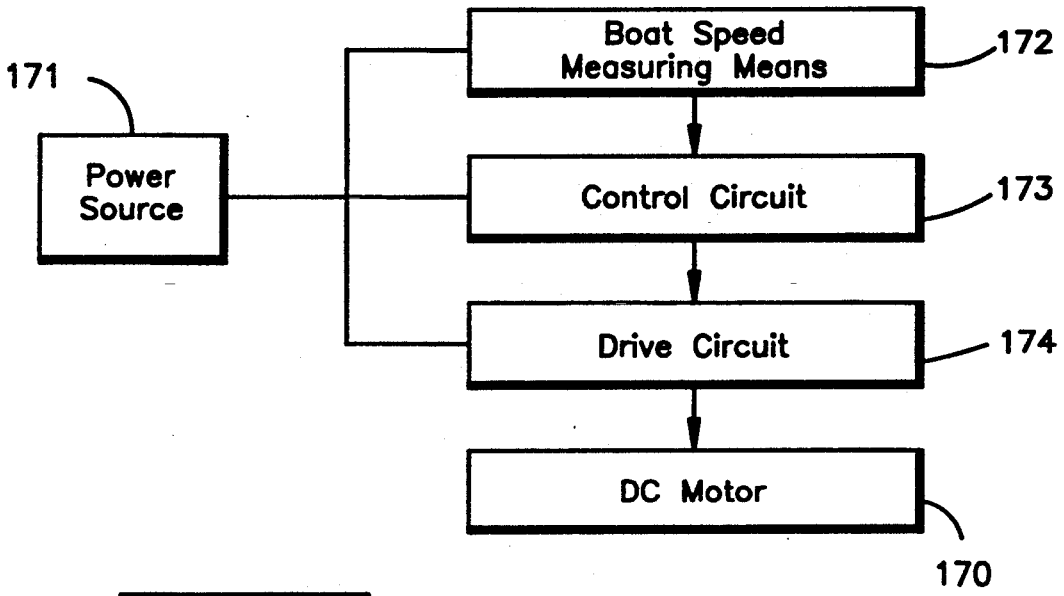
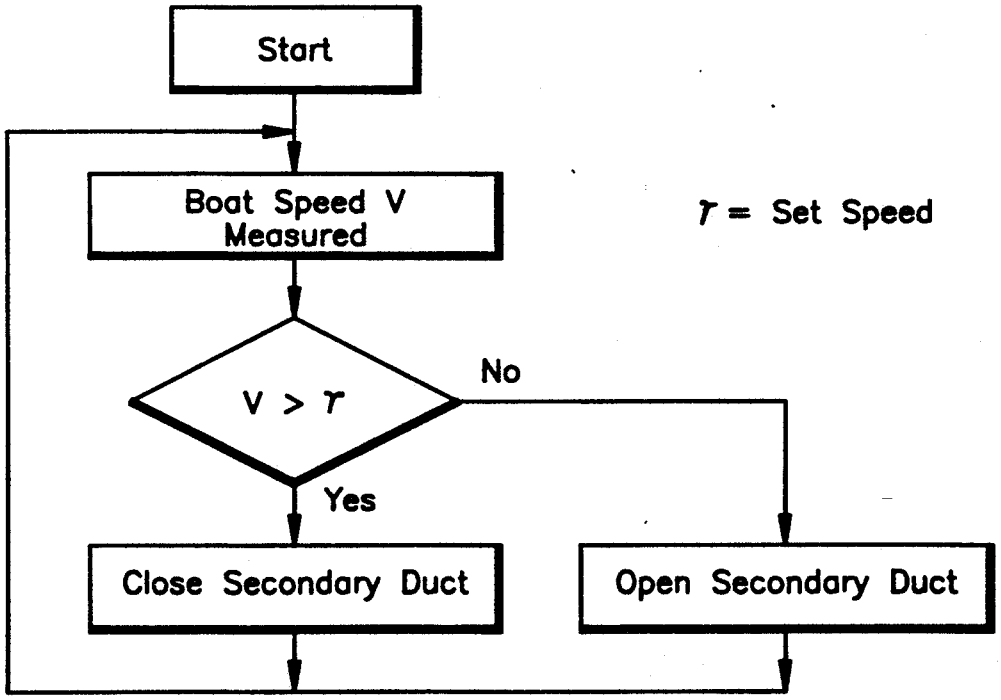
FIG. 6

JET PUMP SYSTEM FOR A WATER JET PROPELLED BOAT

BACKGROUND OF THE INVENTION

The present invention relates to a jet pump system for a water jet propelled boat, more particularly such a system which controls the water inlet as a function of boat speed.

Water jet propelled boats are well-known in the art and typically have a motor driven impeller located in a water duct. Water, which is drawn into the duct through a water intake opening in the bottom of the boat, is accelerated by the impeller and is ejected through a steering nozzle located in the stern of the boat. The reaction force of the water through the nozzle propels the boat forward. The nozzle may be pivoted about a generally vertical axis to steer the boat.

In the past, the water intake opening and the water duct have been made of a rigid material, such as metal or fiberglass reinforced plastic (FRP) and have been fixed in area. The fixed areas of the water intake opening and the water duct have inherently resulted in a compromise in boat performance. Depending upon the speed of the boat, different dynamic pressures act on the water intake. The dynamic pressures are higher when the boat is running at high speed and are lower when it is running at low speeds. Therefore, in boats where high speed operating characteristics are important, the water intake opening has been designed to have a relatively small area to prevent unneeded water from being introduced into the water duct which thereby increases drag on the boat. The smaller water intake opening allows the boat to achieve optimum speeds.

With the high speed boats, however, their low speed acceleration characteristics are poor. Because of the small area of the water intake opening, which facilitates high speed operation, almost no dynamic pressure is acting upon it during low speed operations. Even if the impeller can draw some water into the water duct, there is increased resistance at the water intake opening, due to its small area, which prevents sufficient water from being drawn into the water duct to achieve good acceleration characteristics.

In boats intended for low speed operation, the water intake opening is designed with a large area to enable sufficient water to be drawn into the opening with little dynamic pressure at low speeds. With this type of boat propulsion, however, the dynamic pressure increases when cruising at high speeds since more water is drawn in than is needed by the pump. This increases pump resistance and lowers the maximum speed.

Thus, the known water jet propelled boats with fixed water intake openings could not achieve both high and low speed optimum operations.

The adjustment of the water intake angle also contributes to the enhanced operational characteristics. When cruising at low speeds, the relative speed between the boat and the water is low and, in a direction parallel to the water intake opening (parallel to the bottom of the boat) there is a low water inflow speed. Therefore, a higher water entry angle at low speeds allows water to flow into the duct without significant resistance. This results in good low speed acceleration characteristics.

When operating at high speeds, however, because of the greater water entry speed in a direction parallel to the water intake opening, water becomes detached from the leading edge of the water inlet, thereby increasing the duct resistance, lowering intake efficiency and lowering maximum speed. If the water entry angle is reduced at the water intake opening, this high speed shear is prevented, thereby enhancing high speed operation. However, this increases the intake resistance at the water intake opening during low speed operation and causes poor acceleration characteristics.

SUMMARY OF THE INVENTION

A jet pump system for a water jet propelled boat is disclosed that provides for the adjustment of the area of the water intake opening or the water entry angle as a function of the speed of the boat. During low speed operation, the water inlet opening is adjusted to a maximum area, or the water entry angle is adjusted to a maximum angle to enable sufficient water to enter the water duct and permit efficient impeller operation. As the boat speed increases, the water inlet area is reduced, or the water inlet angle is reduced to prevent excess water from entering the water duct, thereby reducing the drag on the boat.

The present invention provides a mechanism for varying the water entry angle into the duct, more particularly the angle between a wall of the water inlet duct and the bottom of the boat to allow optimum performance in both high and low speed operating modes.

By decreasing the area of the water intake opening as the boat speed increases, the requisite amount of water can be taken into the water duct without excess water resistance. The area of the water intake opening is at a maximum when the boat operates at low speeds to enable a sufficient amount of water to be taken into the water duct without negative pressure developing. During low speed operation, the water entry angle is also at a maximum so that if the boat is accelerated, sufficient water can be drawn into the duct without undue resistance. The water entry angle of the duct is reduced during high speed operation so as to prevent the development of shear in the area of the intake opening.

BRIEF DESCRIPTION OF THE DRAWINGS

FIG. 5 is a schematic diagram of the control system for the second embodiment of the jet pump system according to the present invention.

FIG. 6 is a flow chart for the control system schematically illustrated in FIG. 5.

DETAILED DESCRIPTION OF THE PREFERRED EMBODIMENTS

Figure 1:
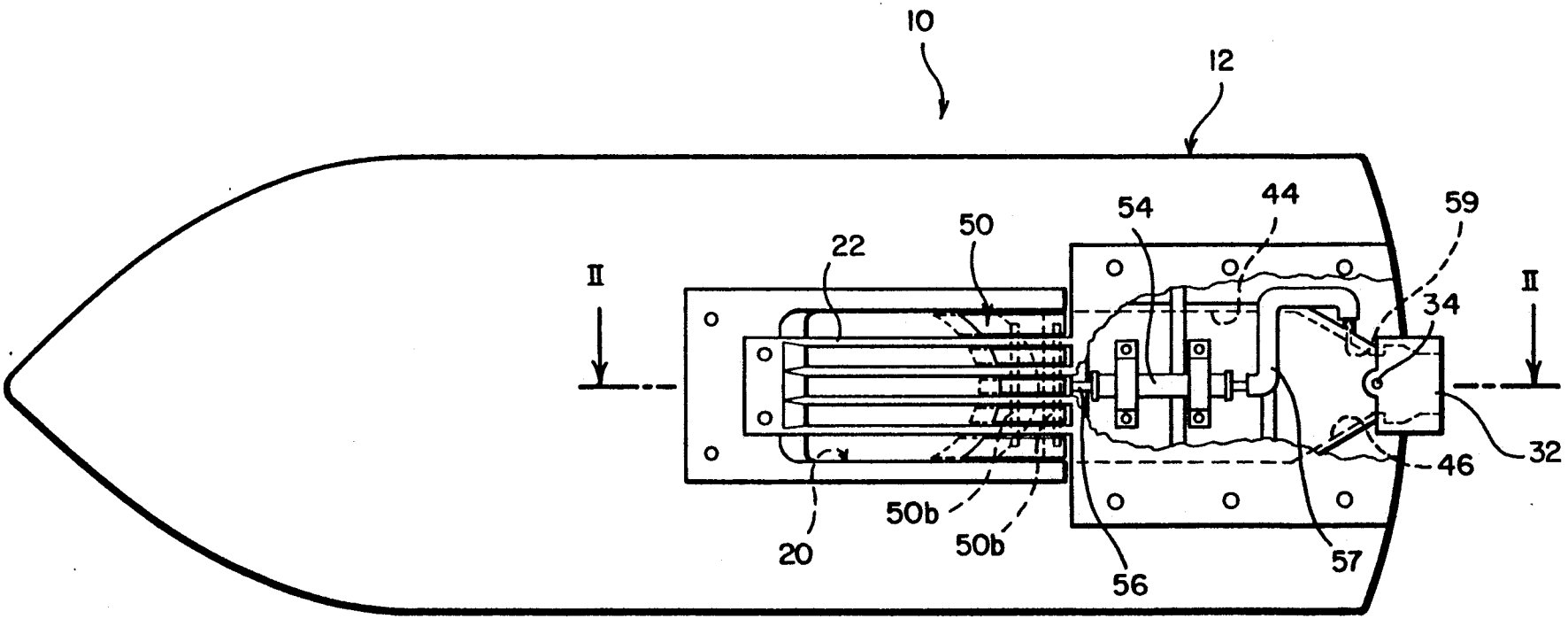
FIG. 1 is a bottom view of a boat with a first embodiment of the jet pump system according to the present invention.
Figure 2:
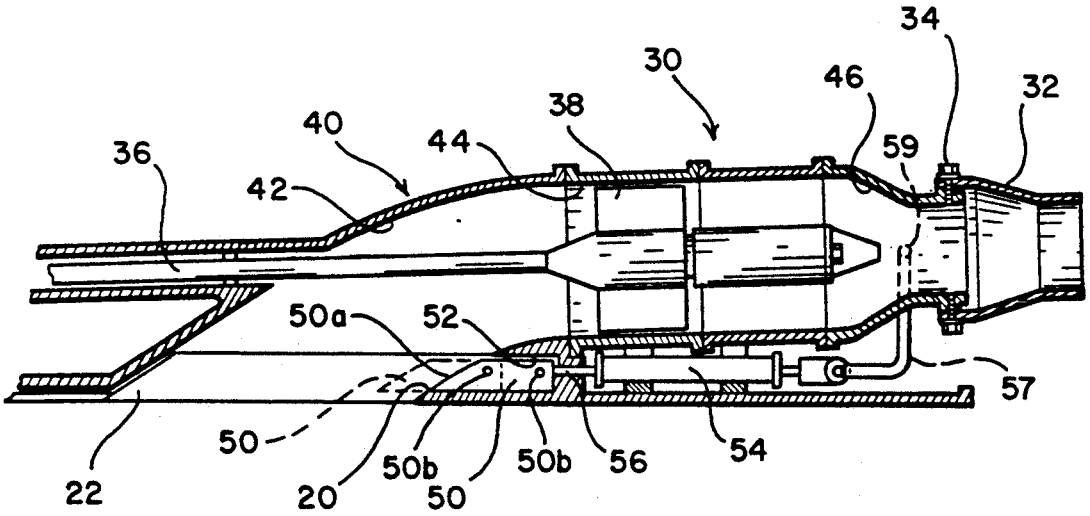
FIG. 2 is a cross-sectional view taken along line II—II in FIG. 1.

The first embodiment of the present invention will be described in reference to FIGS. 1 and 2. A boat hull 10 has boat bottom 12 which defines a generally rectangular water intake opening 20. A pump unit 30 comprises a steering nozzle 32 which may be attached so as to pivot around pivot shaft 34 to enable the steering nozzle 32 to move left or right so as to steer the boat. Drive shaft 36 is driven by an engine (not shown) so as to rotate impeller 38, which is affixed to the rear portion of the drive shaft 36. A water duct 40 communicates with a water intake opening 20 and the steering nozzle 32. The water duct 40 comprises a forward section 42, a midsection 44 having a generally horizontal orientation and surrounding the impeller 38, and a constricted, downstream portion 46 which is connected to the steering nozzle 32.

The rotation of impeller 38 within the water duct 40 creates a water jet flow. This jet flow uses water drawn in through the water intake opening 20, which then passes through forward section 42 of the water duct 40 into the mid section 44. The water is accelerated through the constricted portion 46 by the impeller 38 and is ejected through nozzle 32. The reaction from the jet stream drives the boat forward.

A screen 22 may be attached over the water intake opening and may comprise a plurality of rod-shaped elements running fore and aft in the direction of travel of the boat. Screen 22 prevents foreign matter from entering the duct and contacting the rotating impeller. A slide valve 50 is located in the rear portion of water intake opening 20 and is mounted so as to slide freely in valve groove 52. As shown in FIG. 1, slide valve 50 may comprise individual valve elements located between the rod members of the screen 22 and which are connected by rod 50*b*. The slide valve 50 is configured such that it slides fore and aft in the spaces defined by the water intake opening and the screen 22. The leading edge 50*a* of the slide valve 50, when viewed from the top or bottom, forms a generally "U" shape. Its configuration when viewed from the side, as seen in FIG. 2, is such that its lower edge protrudes beyond an upper edge so that it conforms to the shape of the inner surface of forward section 42 of water duct 40.

Slide valve 50 is operatively linked to piston rod 56 which is slidably connected to a piston within cylinder 54. Cylinder 54 is attached to the boat structure outside of the water duct 40. The interior of cylinder 54 communicates with the constricted area 46 of the water duct 40 by pressure hose 57 and opening 59. A compressed spring (not shown) is located within cylinder 54 and exerts a force against the piston rod 56 so as to bias the slide valve 50 to a normally open position.

During low speed operation, the rotational speed of impeller 38 is relatively low, thereby creating a relatively weak jet stream in the mid section 44 of the water duct 40. This jet stream is accelerated in the constricted area 46, but since the jet flow is weak, the pressure does not rise to a great extent in the constricted area 46.

The pressure within the constricted area 46 is transmitted to the inside of cylinder 54 via the pressure intake opening 59 and pressure hose 57. This pressure, at low speeds, is insufficient to overcome the force of the compressed spring, so the slide valve 50 remains biased to its open position, shown by solid lines in FIGS. 1 and 2. When slide valve 50 is in its fully open position, the area of the water intake opening 20 is at its maximum, enabling a large amount of water to enter the intake opening 20 without significant resistance.

As the rotational speed of impeller 38 is increased during acceleration of the boat, the strength of the jet flow it produces will also increase. At the beginning of acceleration, the rotational speed of impeller 38 is not significantly increased, therefore the water pressure does not build up sufficiently high in the constricted area 46 to overcome the force of the compressed spring. Thus the slide valve 50 remains in its fully open position.

Increased rotation of impeller 38 during acceleration further increases the pressure in the constricted area 46, but it is still not great enough to overcome the biasing force of the compressed spring. Accordingly, slide valve 50 remains open.

When a high cruising speed is achieved, a dynamic pressure resulting from the boat speed acts on the water intake opening. As a result, more water enters water duct 40 and, with this increased water volume, the pressure within constricted portion 46 increases further. This increased pressure is transmitted to cylinder 54 by means of the pressure outlet 59 and pressure hose 57. At this point, this pressure overcomes the force of the compressed spring, thereby urging the piston rod toward the left (as seen in FIG. 2) closing the slide valve 50. Closing slide valve 50 diminishes the area of the water intake opening 20 so as to prevent more water from entering the duct 40 than is needed. This prevents an increase in water resistance at the water intake opening which would be present had the water intake area not been reduced.

The second embodiment of the invention will be described with reference to FIGS. 3–6. In this embodiment, elements having the same function as those in the previously described embodiment are referred by the same reference numerals increased by 100. It is to be understood that the impeller, water duct and exit nozzle function in the same manner as in the previously described embodiment.

Figure 3:
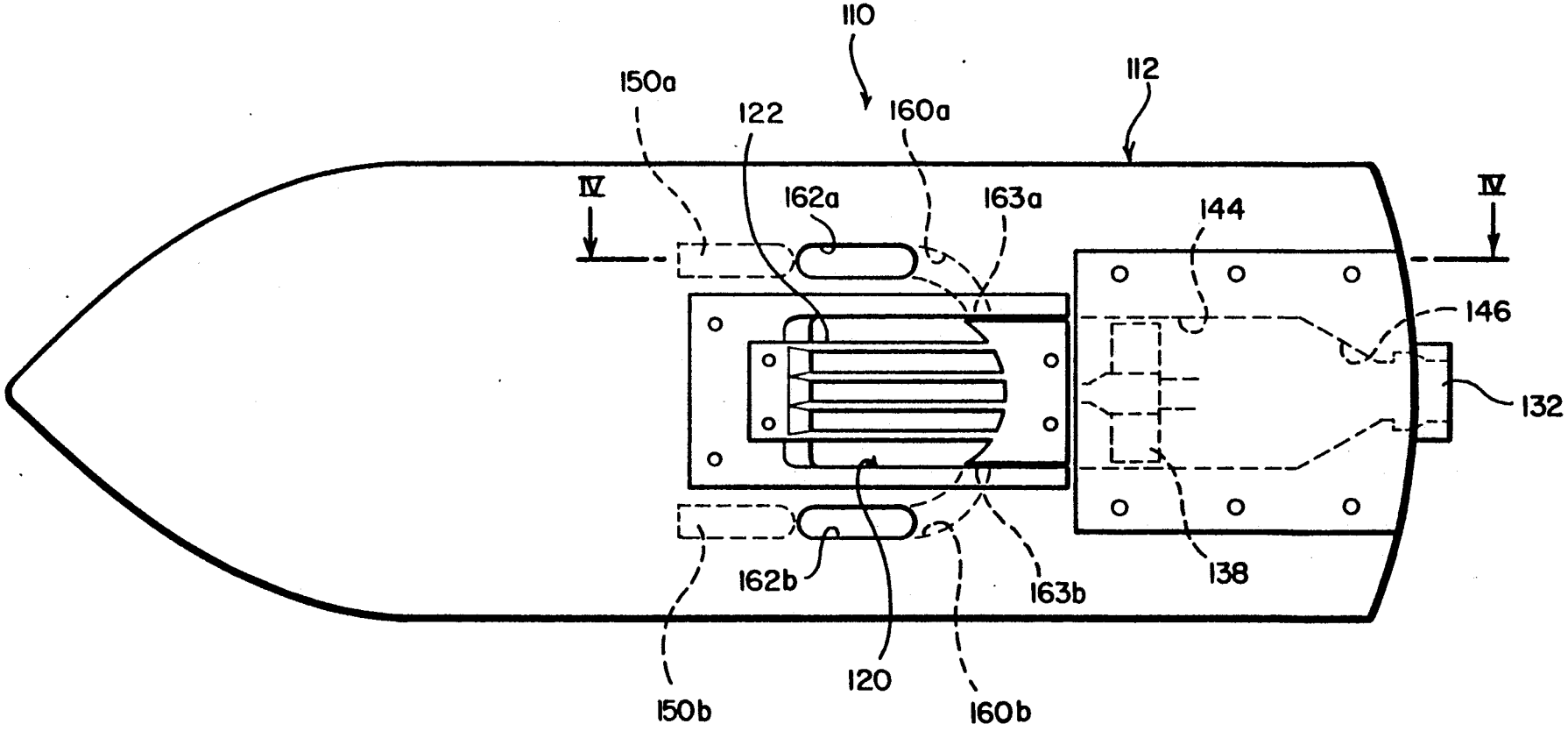
FIG. 3 is a bottom view of a boat with a second embodiment of the jet pump system according to the present invention.

As can be seen in FIG. 3, secondary water intake openings 162*a* and 162*b* are located on either side of primary water intake 120, which is located in the center of the boat bottom 112. Secondary water intake openings 162*a* and 162*b* communicate with the inlet portion 142 of water duct 140 via secondary ducts 160*a* and 160*b* and openings 163*a* and 163*b*. In this embodiment, the primary water intake opening 120 does not have a slide valve. Instead, slide valves 150*a* and 150*b* are operatively associated with the secondary water intake openings 162*a* and 162*b*. Slide valves 150*a* and 150*b* do not partially open or close the secondary water intake openings 162*a* and 162*b*, but, rather, they can fully open or fully close these openings to allow or prevent water from entering the secondary ducts 160*a* and 160*b*.

The slide valves 150*a* and 150*b* may be operated by a motor 170, which may be a DC motor, which is supported by the bottom 112 of the boat 110. Motor 170 has connecting rods 156*a* and 156*b* linking it to the slide valves 150*a* and 150*b*, respectively, such that, when motor 170 operates, the slide valves 150*a* and 150*b* can be opened or closed.

Figure 4:
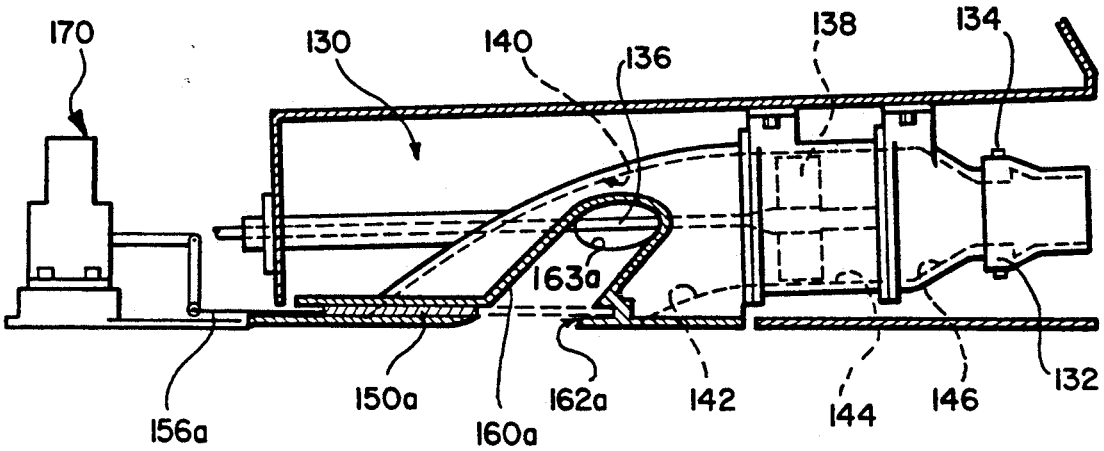
FIG. 4 is a cross-sectional view taken along line IV—IV in FIG. 3.

The jet pump system shown in FIGS. 3 and 4 utilizes a boat speed measuring means to detect the speed of the boat and open or close the slide valves 150*a* and 150*b* in accordance with the boat speed. A control system, which is schematically illustrated in FIGS. 5 and 6, has a power source 171, means for measuring the boat speed 172, control circuit 173 and a drive circuit 174. The boat speed measuring means 172 measures the speed of the boat V. The control circuit 173 compares the measured boat speed V with a predetermined speed $\gamma$ as illustrated in FIG. 6 and, if V is greater than $\gamma$ a command signal is sent to motor drive circuit 174 and slide valves 150*a* and 150*b* are closed. If V is less than or equal to $\gamma$, (during low speed operation), the drive signal to the motor 170*b* causes the slide valves 150*a* and 150*b* to open.

During low speed operation and accelerating from low speed operation, the secondary water intake openings 162*a* and 162*b* remain open to enable water to enter through secondary ducts 160*a* and 160*b* into the water duct 140. This insures a sufficient water supply to the impeller 138.

When high speed cruising has been attained, such that the V is greater than $\gamma$, motor 170 closes the slide valves 150*a* and 150*b* so that water cannot enter the secondary ducts 160*a* and 160*b*. Thus, water is drawn into the water duct 140 only through the water intake opening 120.

In this embodiment, a sufficiently large area of water intake openings is maintained during low speed operations so that sufficient water can be drawn in when the dynamic pressure is insufficient. This allows good acceleration characteristics. During high speed cruising operations, the secondary water intake openings 162*a* and 162*b* are closed, leaving only water intake opening 120 open so that the total water intake area decreases to avoid undue resistance.

Figure 7:
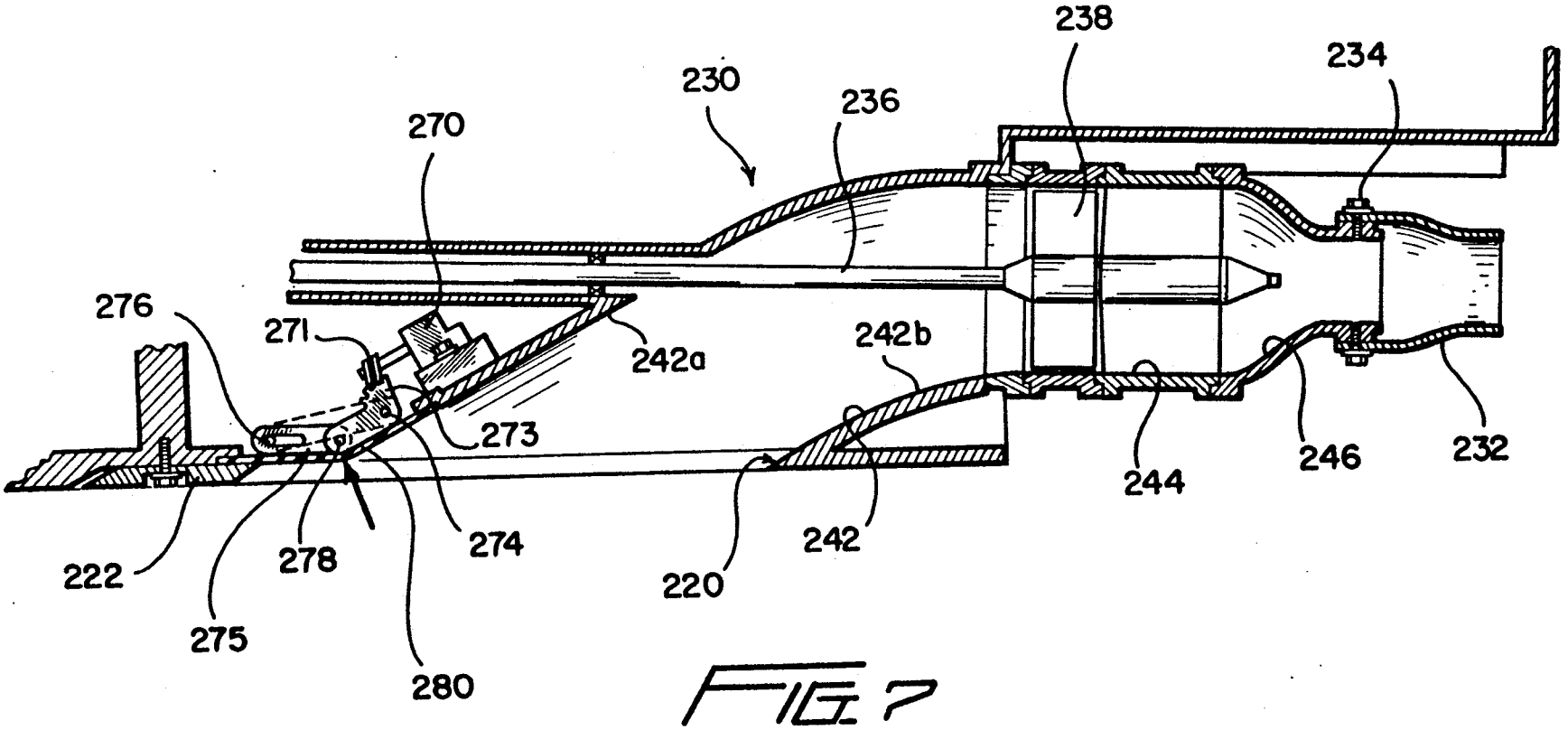
FIG. 7 is a partial, cross-sectional view of a third embodiment of the jet pump system according to the present invention.

A third embodiment of the present invention will be described in reference to FIGS. 7–9. In these figures, elements having the same functions as those of the first embodiment will be referred to by the same numerals increased by 200. It is to be understood that the water duct 242, 244 and 246, impeller 238 and exit nozzle 232 function the same as in the previously described embodiments.

In this embodiment, a slide valve is not used, but a movable wall portion 280 is utilized to adjust the water entry angle of the forward section 242 of the water inlet duct. The movable wall 280 may be formed from a flexible material, such as rubber, and may be located in an upstream wall 242*a* of the forward section 242. A leading edge of the movable wall 280 is held in place between the front edge of the water intake opening 220 and the screen 222. A trailing edge of the movable wall 280 is attached to the upstream wall 242*a* of the forward section 242 such that it is flush therewith.

A motor 270, which may be DC motor, is attached to an external side of the upstream wall 242*a*. An arm member 273 is also pivotally attached to an external side of the upstream wall 242*a* via pivot pin 274. A portion of arm member 273 is formed as a sector gear which engages a worm gear 271 driven by the motor 270. A second, sliding arm 275 has one end pivotally attached to the arm member 273 by pivot pin 278, while its opposite end is linked to a pin 276 extending through an elongated hole formed in the sliding arm 275. Pin 276 may be affixed to the upstream wall portion 242*a*. The pivot pin 278 interconnects the arm member 273 and sliding arm 275. The arm member 273 and sliding arm 275 are located such that they bear against a side of the movable wall 280.

Figure 8:
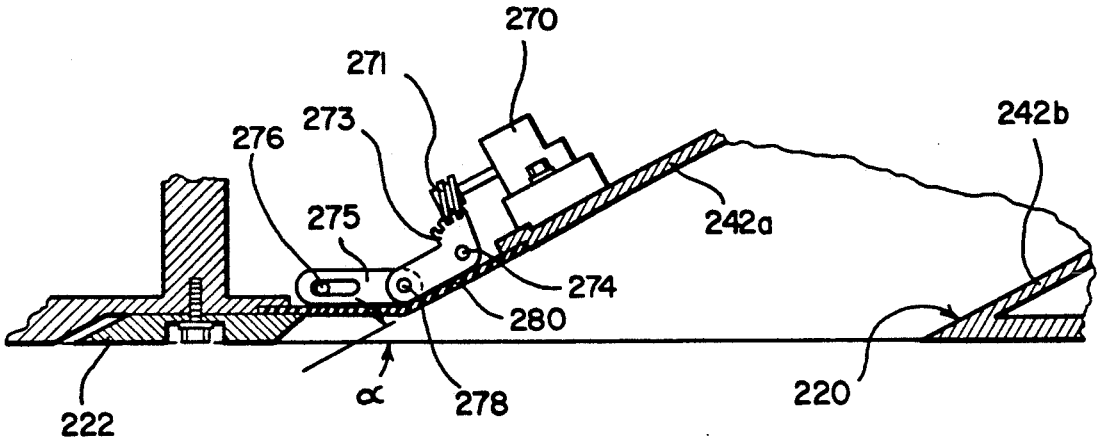
FIG. 8 is an enlarged partial, cross-sectional view of the jet pump system shown in FIG. 7 with the flexible wall oriented in a first position.

During low speed operations, the movable wall is positioned as shown in FIG. 8. In this position, the movable wall 280 forms an angle $\alpha$ with the bottom 112 of the boat. In order to change the water inlet angle of movable wall 280 a drive command is issued to motor 270 which causes worm gear 271 to rotate. Such rotation of worm gear 271 causes arm member 273 to rotate around pivot pin 274 in a clockwise direction (as shown in FIG. 8). Sliding arm 275 also slides around pin 276 in a counter clockwise direction due to its connection with the arm 273 through pivot pin 278.

Figure 9:
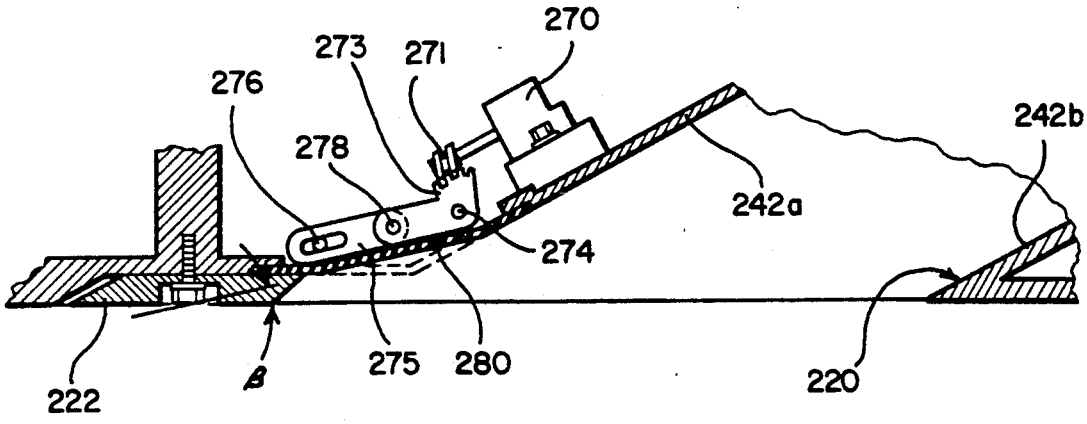
FIG. 9 is an enlarged cross-sectional view similar to FIG. 8, showing the flexible wall in a second position.

Such movement, as illustrated in FIG. 9, allows the movable wall 280 to assume an angle $\beta$ with respect to the bottom of the boat. As can be seen, angle $\beta$ is less than angle $\alpha$.

The movable wall 280 is positioned as shown in FIG. 8 during low speed operations such that entry angle $\alpha$ is formed. This allows more water to enter the water duct during low speed operations. When a transition is made from low to high speed operations, the water entry angle is adjusted to the smaller angle $\beta$ to lower the resistance during such operations and to reduce the shear which occurs when too much water strikes the upstream wall 242*a*. This retains the efficiency of the water intake opening during high speed operations.

The drive command to motor 270 may be issued by a control system which senses the boat speed similar to the control system illustrated in FIGS. 5 and 6.

Although, in this embodiment, the movable wall was illustrated as being associated with an upstream wall portion of the water intake duct, it is to be understood that a downstream wall 242*b* of duct could accommodate the movable wall portion so as to vary the water entry angle.

The foregoing description is provided for illustrative purposes only and should not be construed as in any way limiting this invention, the scope of which is defined solely by the appended claims.

We claim:

1. A jet pump system for a water jet propelled boat having a bottom and a driving impeller rotatable in a water duct, comprising:

a) a water inlet duct communicating with the water duct so as to direct water into the water duct, the water inlet duct having an inlet portion defining at least one water intake opening;

b) adjustment means comprising a slide valve member operatively associated with the water inlet duct so as to be slidably movable across the at least one water intake opening so as to vary the area of the at least one water intake opening in relation to the speed of the boat;

c) actuating means operatively connected to the slide valve member so as to slide the slide valve member across the at least one water intake opening; and d) boat speed sensing means operatively connected to the actuating means such that the slide valve member automatically decreases the area of the at least one water intake as the speed of the boat increases beyond a predetermined speed, wherein the boat speed sensing means comprises: (i) a constricted flow section defined by the water inlet duct downstream of the driving impeller; and (ii) a pressure hose opening into the constricted flow section and operatively connected to the actuating means.

2. The jet pump system of claim 1 wherein the actuating means comprises an actuating cylinder connected to the slide valve member and operatively associated with the pressure hose such that boat speed above a predetermined speed increases pressure in the constricted flow section, which increased pressure causes the actuating cylinder to move the slide valve member so as to reduce the area of the water intake opening.

3. The jet pump system of claim 2 wherein the actuating cylinder further comprises a piston rod connected to the slide valve member and biasing means biasing the slide valve member toward a position in which the area of the water intake opening is at a maximum.

4. The jet pump system of claim 1 wherein the actuating means causes the slide valve member to decrease the area of the at least one water intake opening when the boat speed increases beyond a predetermined speed and to increase the area of the at least one water intake opening when the boat speed decreases below the predetermined speed.

* * * * *